US008397861B1

(12) United States Patent
Xu et al.

(10) Patent No.: US 8,397,861 B1
(45) Date of Patent: Mar. 19, 2013

(54) DIAPHRAGM SURROUND

(75) Inventors: Zhen Xu, Waltham, MA (US); Robert Preston Parker, Westborough, MA (US); Allen T. Graff, Sutton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 13/410,636

(22) Filed: Mar. 2, 2012

(51) Int. Cl.

| | |
|---|---|
| ***H04R 7/20*** | (2006.01) |
| ***H04R 7/18*** | (2006.01) |
| ***H04R 1/28*** | (2006.01) |
| ***H04R 1/22*** | (2006.01) |
| *H04R 7/16* | (2006.01) |
| *H04R 1/20* | (2006.01) |

(52) U.S. Cl. ..... 181/171; 181/172; 381/392

(58) Field of Classification Search ..... 181/171, 181/172, 166, 173, 174; 381/87, 386, 392, 381/395, 423, 429

See application file for complete search history.

(56) References Cited

U.S. PATENT DOCUMENTS

| | | | | | |
|---|---|---|---|---|---|
| 1,514,511 | A | | 11/1924 | Fischer | |
| 1,621,670 | A | | 3/1927 | Jokel | |
| 1,732,351 | A | | 10/1929 | Borkman | |
| 1,744,032 | A | * | 1/1930 | Baldwin | 181/171 |
| 1,759,725 | A | | 5/1930 | Young et al. | |
| 1,821,933 | A | | 9/1931 | Darnell | |
| 1,829,355 | A | * | 10/1931 | Houghton | 181/173 |
| 1,832,608 | A | | 11/1931 | Abrahams | |
| 2,020,705 | A | | 11/1935 | Stenger | |
| 2,302,178 | A | | 11/1942 | Brennan | |
| 2,439,665 | A | | 4/1948 | Marquis | |
| 2,439,666 | A | | 4/1948 | Marquis | |
| 2,442,791 | A | * | 6/1948 | Wente | 181/172 |
| 2,624,417 | A | | 1/1953 | Brennan | |
| 2,863,520 | A | | 12/1958 | Manley | |
| 3,154,173 | A | | 10/1964 | Petrie | |
| 3,436,494 | A | | 4/1969 | Bozak | |
| 3,563,337 | A | | 2/1971 | Kawamura | |
| 3,925,626 | A | * | 12/1975 | Stallings, Jr. | 381/430 |
| 3,961,378 | A | | 6/1976 | White | |
| 3,983,337 | A | | 9/1976 | Babb | |
| 3,997,023 | A | | 12/1976 | White | |
| 4,056,697 | A | * | 11/1977 | Heil | 381/408 |
| 4,198,550 | A | | 4/1980 | Matsuda et al. | |

(Continued)

FOREIGN PATENT DOCUMENTS

| | | | |
|---|---|---|---|
| EP | 1278397 | A2 | 1/2003 |
| EP | 1381251 | A2 | 1/2004 |

(Continued)

OTHER PUBLICATIONS

International Search Preliminary Report on Patentability, dated Jul. 28, 2009 issued for PCT/US2008/063562 filed May 14, 2008.

(Continued)

*Primary Examiner* — Edgardo San Martin
(74) *Attorney, Agent, or Firm* — Bose Corporation

(57) ABSTRACT

A surround for supporting a diaphragm used to create acoustic waves includes a plurality of first rib sections extending away from the diaphragm and a second rib section having a zigzag pattern and being secured to an end of each of the first rib sections. As the diaphragm starts moving away from a home position in an intended direction of travel which is substantially perpendicular to a plane in which the diaphragm lies when the diaphragm is in the home position, the zigzag pattern of the second rib section starts to straighten out.

20 Claims, 6 Drawing Sheets

U.S. PATENT DOCUMENTS

| | | | | |
|---|---|---|---|---|
| 4,235,302 | A | 11/1980 | Tsukamoto | |
| 4,257,325 | A | 3/1981 | Bertagni | |
| 4,321,434 | A | 3/1982 | Irie | |
| 4,324,312 | A | 4/1982 | Durbin | |
| 4,353,432 | A * | 10/1982 | Hasegawa et al. | 181/166 |
| 4,433,214 | A | 2/1984 | Jasinski | |
| 4,440,259 | A | 4/1984 | Strohbeen | |
| 4,552,243 | A | 11/1985 | Melillo et al. | |
| 5,094,404 | A * | 3/1992 | DesRosiers et al. | 242/118.11 |
| 5,148,492 | A | 9/1992 | Uzawa et al. | |
| 5,150,417 | A | 9/1992 | Stahl | |
| 5,204,501 | A | 4/1993 | Tsao | |
| 5,319,718 | A | 6/1994 | Yocum | |
| 5,371,805 | A | 12/1994 | Saiki et al. | |
| 5,418,337 | A | 5/1995 | Schreiber | |
| 5,455,396 | A | 10/1995 | Willard et al. | |
| 5,650,105 | A | 7/1997 | Yocum | |
| 5,740,264 | A | 4/1998 | Kojima | |
| 5,748,759 | A | 5/1998 | Croft et al. | |
| 5,749,433 | A | 5/1998 | Jackson | |
| 5,881,989 | A | 3/1999 | O'Brien et al. | |
| 6,044,925 | A | 4/2000 | Sahyoun | |
| 6,075,866 | A * | 6/2000 | Frasl et al. | 381/177 |
| 6,169,811 | B1 | 1/2001 | Croft, III | |
| 6,176,345 | B1 | 1/2001 | Perkins et al. | |
| 6,219,432 | B1 * | 4/2001 | Fryer et al. | 381/398 |
| 6,224,801 | B1 | 5/2001 | Mango, III | |
| 6,305,491 | B2 | 10/2001 | Iwasa et al. | |
| 6,347,683 | B2 | 2/2002 | Schriever | |
| 6,390,232 | B1 | 5/2002 | Kirschbaum | |
| 6,396,936 | B1 | 5/2002 | Nevill | |
| 6,449,375 | B1 | 9/2002 | Hutt | |
| 6,611,604 | B1 | 8/2003 | Irby et al. | |
| 6,697,496 | B2 | 2/2004 | Frasl | |
| 6,725,967 | B2 | 4/2004 | Hlibowicki | |
| 6,851,513 | B2 | 2/2005 | Stead et al. | |
| 6,889,796 | B2 | 5/2005 | Pocock et al. | |
| 6,920,957 | B2 | 7/2005 | Usuki et al. | |
| 6,957,714 | B2 | 10/2005 | Takahashi et al. | |
| 7,054,459 | B2 | 5/2006 | Kuze et al. | |
| 7,306,073 | B2 | 12/2007 | Frasl | |
| 7,397,927 | B2 | 7/2008 | Pircaro et al. | |
| 7,428,946 | B2 | 9/2008 | Honda et al. | |
| 7,480,390 | B2 | 1/2009 | Tabata et al. | |
| 7,510,047 | B2 * | 3/2009 | Muto et al. | 181/173 |
| 7,699,139 | B2 | 4/2010 | Subramaniam et al. | |
| 7,839,052 | B2 * | 11/2010 | Wu et al. | 310/321 |
| 7,931,115 | B2 | 4/2011 | Silver | |
| 2002/0150261 | A1 | 10/2002 | Moeller et al. | |
| 2003/0015369 | A1 | 1/2003 | Sahyoun | |
| 2004/0106454 | A1 | 6/2004 | Walker et al. | |
| 2006/0162993 | A1 | 7/2006 | Honda et al. | |
| 2007/0201712 | A1 | 8/2007 | Saiki | |
| 2007/0261912 | A1 * | 11/2007 | Langberg | 181/171 |
| 2008/0212808 | A1 * | 9/2008 | Omoda | 381/191 |
| 2009/0139794 | A1 * | 6/2009 | Silver | 181/171 |

FOREIGN PATENT DOCUMENTS

| | | | |
|---|---|---|---|
| GB | 329278 | A | 5/1930 |
| JP | 52055736 | A | 5/1977 |
| JP | 10257590 | A * | 9/1998 |

OTHER PUBLICATIONS

International Search Report and Written Opinion in Application No. PCT/US2008/063562, dated Sep. 4, 2008.

Japanese Examined Utility Model Application, Second Publication No. S55-006237. No English version available, Feb. 13, 1980.

Japanese Examined Application, Second Publication No. 531-004159. No English version available, Mar. 29, 2009.

Japanese Utility Model Application No. S59-038266. First Publication No. S60-150890. No English version available, Oct. 7, 1985.

Published Japanese Translation No. H07-503108 of PCT International Publication No. WO193/14608, Mar. 30, 1995.

Japanese Examined Patent Application, Second Publicatioon No. S45-025827, Aug. 26, 1970.

JP Office Action dated Jun. 30, 2011 for CN 2010510405.

CN Office Action dated Jan. 12, 2012 for CN 200880016976.0.

Second Chinese Office Action dated Nov. 15, 2012 for CN 200880016976.0.

* cited by examiner

DIAPHRAGM SURROUND

BACKGROUND

This disclosure relates to a surround for supporting a diaphragm that is used to create acoustic waves. The surround and diaphragm can be part of a passive radiator or acoustic driver.

Passive radiators and acoustic drivers have been traditionally designed with half roll surrounds having a circular or elliptical cross section. Such half roll surrounds are typically made of high durometer materials. This arrangement provides approximate linear force-deflection response until the surround reaches a high strain that results in a non-linear response. In many surround designs, issues of buckling and hoop stresses can result in an unstable dynamic response (like sub harmonic rocking) which is detrimental to the acoustic performance. A challenge in designing a passive radiator is the unstable behavior or non-axial motion of the diaphragm which can occur under dynamic loading. This is largely related to the nonlinear force deflection relationship of the passive radiator which is due to the geometry linearity and material linearity. Instabilities due to nonlinear force-deflection have been avoided by limiting the magnitude of passive radiator excursion, resulting in less acoustic output for a given size passive radiator.

U.S. Pat. No. 7,699,139 discloses a surround for supporting a diaphragm used to create acoustic waves. The surround includes a rib section extending away from the diaphragm and a membrane section that is supported by the rib section. The membrane section has a thickness in a direction substantially normal to opposing top and bottom surfaces of the membrane section which is substantially thinner than a thickness of the rib section in a direction substantially normal to opposing top and bottom surfaces of the rib section. A restoring force returning the diaphragm to a home position is contributed to more due to deformation of the rib section than to deformation of the membrane section.

SUMMARY

In one aspect, a surround for supporting a diaphragm used to create acoustic waves includes a first rib section extending away from the diaphragm and a second rib section having two end portions and a middle portion. An end of the first rib section is secured to the middle portion of the second rib section. The first rib section is closer to the diaphragm than the second rib section. A first membrane section is supported by the first rib section and has a thickness in a direction substantially normal to opposing top and bottom surfaces of the membrane section which is substantially thinner than a thickness of the first rib section in a direction substantially normal to opposing top and bottom surfaces of the first rib section. A point on the middle portion of the second rib section that is closest to the diaphragm is located farther from the diaphragm than a point on at least one of the end portions of the second rib section that is closest to the diaphragm.

Embodiments may include one or more of the following features. The point on the middle portion of the second rib section can be located farther from the diaphragm than respective points on both of the end portions of the second rib section that are closest to the diaphragm. The thickness of the membrane section can be substantially thinner than a thickness of the second rib section in a direction substantially normal to opposing top and bottom surfaces of the second rib section. At least a portion of the membrane can have a curved shape. The surround can further include a third rib section extending away from the diaphragm and a fourth rib section having two end portions and a middle portion. An end of the third rib section can be secured to the middle portion of the fourth rib section. A second membrane section can be supported by the third rib section. The membrane section can have a thickness in a direction substantially normal to opposing top and bottom surfaces of the membrane section which is substantially thinner than a thickness of the third rib section in a direction substantially normal to opposing top and bottom surfaces of the third rib section. A point on the middle portion of the fourth rib section that is closest to the diaphragm can be located closer to the diaphragm than a point on at least one of the end portions of the fourth rib section that is closest to the diaphragm. The point on the middle portion of the fourth rib section can be located closer to the diaphragm than respective points on both of the end portions of the fourth rib section that are closest to the diaphragm. The thickness of the membrane section can be substantially thinner than a thickness of the fourth rib section in a direction substantially normal to opposing top and bottom surfaces of the fourth rib section.

In another aspect, a surround for supporting a diaphragm used to create acoustic waves includes a first rib section extending away from a frame which supports the surround and a second rib section having two end portions and a middle portion. An end of the first rib section is secured to the middle portion of the second rib section. The first rib section is closer to the frame than the second rib section. A first membrane section is supported by the first rib section and has a thickness in a direction substantially normal to opposing top and bottom surfaces of the membrane section which is substantially thinner than a thickness of the first rib section in a direction substantially normal to opposing top and bottom surfaces of the first rib section. A point on the middle portion of the second rib section that is closest to the diaphragm is located closer to the diaphragm than a point on at least one of the end portions of the second rib section that is closest to the diaphragm.

Embodiments may include one or more of the following features. The point on the middle portion of the second rib section is located closer to the diaphragm than respective points on both of the end portions of the second rib section that are closest to the diaphragm. The thickness of the membrane section is substantially thinner than a thickness of the second rib section in a direction substantially normal to opposing top and bottom surfaces of the second rib section. At least a portion of the membrane has a curved shape. The surround can further include a third rib section extending away from the diaphragm and a fourth rib section having two end portions and a middle portion. An end of the third rib section can be secured to the middle portion of the fourth rib section. A second membrane section that is supported by the third rib section can have a thickness in a direction substantially normal to opposing top and bottom surfaces of the membrane section which is substantially thinner than a thickness of the third rib section in a direction substantially normal to opposing top and bottom surfaces of the third rib section. A point on the middle portion of the fourth rib section that is closest to the diaphragm can be located farther from the diaphragm than a point on at least one of the end portions of the fourth rib section that is closest to the diaphragm. The point on the middle portion of the fourth rib section is located farther from the diaphragm than respective points on both of the end portions of the fourth rib section that are closest to the diaphragm. The thickness of the membrane section is substantially thinner than a thickness of the fourth rib section in a direction substantially normal to opposing top and bottom surfaces of the fourth rib section.

In yet another aspect, a surround for supporting a diaphragm used to create acoustic waves includes a first rib section extending away from the diaphragm and a second rib section having a zigzag pattern and being secured to an end of the first rib section. As the diaphragm starts moving away from a home position in an intended direction of travel which is substantially perpendicular to a plane in which the diaphragm lies when the diaphragm is in the home position, the zigzag pattern of the second rib section starts to straighten out.

Embodiments may include one or more of the following features. A point on a middle portion of the second rib section is located farther from the diaphragm than respective points on both end portions of the second rib section that are closest to the diaphragm. A thickness of a membrane section is substantially thinner than a thickness of the second rib section in a direction substantially normal to opposing top and bottom surfaces of the second rib section. At least a portion of the membrane has a curved shape. A point on a middle portion of the second rib section is located closer to the diaphragm than respective points on both end portions of the second rib section that are closest to the diaphragm.

In a still further aspect, a surround for supporting a diaphragm used to create acoustic waves includes a first rib section extending away from the diaphragm and a second rib section secured to an end of first rib section. The second rib section extends about at least a portion of a perimeter of the diaphragm. As the diaphragm starts moving away from a home position in an intended direction of travel which is substantially perpendicular to a plane in which the diaphragm lies when the diaphragm is in the home position, a geometric shape of the second rib section starts changing from a shape which is less similar to the at least portion of the perimeter of the diaphragm to a shape which is more like the at least portion of the perimeter of the diaphragm.

DETAILED DESCRIPTION

Active and passive acoustic sources (e.g., drivers and passive radiators) typically include a diaphragm that reciprocates back and forth to produce acoustic waves. This diaphragm (which may be e.g., a plate, cone, cup or dome) is usually attached to a non-moving structure, such as a frame, using a resilient surround member.

Figure 1:
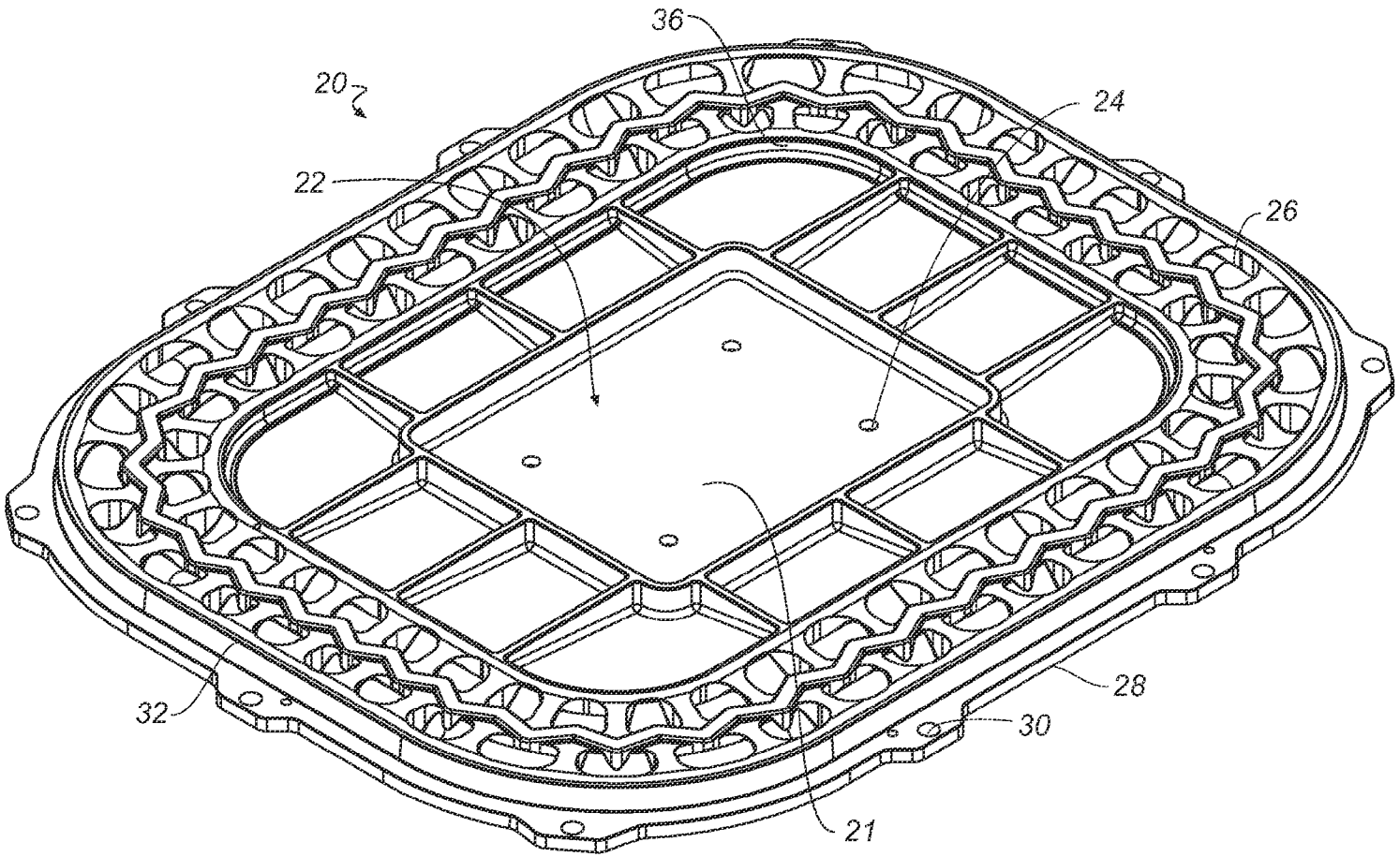
FIG. 1 is a perspective view of a passive radiator.

For example, as shown FIG. 1, a passive radiator 20 includes a surround 26 that connects a diaphragm 22 to an outer frame 28. The frame 28 is typically secured to a speaker box (not shown) around the periphery of an opening in one wall of the speaker box, or other acoustic enclosure. The diaphragm 22 has a top surface 21 which is substantially flat and made of a stiff material such as plastic (e.g., polycarbonate or Acrylonitrile Butadiene Styrene) or metal (e.g., steel or aluminum). Alternatively, the top surface 21 of the diaphragm 22 may be convex or concave shaped to increase the stiffness of the diaphragm.

The diaphragm 22 is exposed to acoustic waves created by another source such as an acoustic driver in a common acoustic enclosure. The acoustic waves cause the diaphragm to vibrate back and forth in an intended direction of travel that is substantially perpendicular to a plane in which the diaphragm lies when the diaphragm is in a home position (at rest). This vibration causes additional acoustic waves to be created and propagated. A group of four holes 24 in the diaphragm 22 is used to secure a mass (not shown) to the diaphragm. The mass may be added to the diaphragm 22 to tune an acoustic system to a desired resonant frequency of vibration.

The surround 26 is secured to and supports diaphragm 22. The surround may be made of a solid or foam elastomer, and in this example is a thermoset soft silicone elastomer such as ELASTOSIL® LR 3070 which is made by Wacker Chemie AG, WACKER-SILICONES, Hanns-Seidel-Platz 4, D-81737 Munich, Germany, www.wacker.com, silicones@wacker.com. Alternatively, the surround 26 may be made of a thermoplastic elastomer such as Uniprene 2012 which is made by Teknor Apex, 505 Central Avenue, Pawtucket, R.I. 02861, 866.438.8737, www.teknorapex.com The thermoset elastomer used to make the surround 26 preferably has (i) a Shore A durometer of between about 5 to about 70, and more preferably has a durometer of about 27; (ii) a 100% elongation static modulus of between about 0.05 MPa to about 10 MPa, and more preferably has a 100% static modulus of between about 0.6 MPa to about 2 MPa; (iii) an elongation at break above about 100%, and more preferably an elongation at break of about 400%; and (iv) a static stiffness of between about 0.05 newtons/mm to about 50 newtons/mm when the diaphragm is at its neutral travel position, and more preferably a static stiffness of about 3 newtons/mm. However, these properties may change depending on various factors (e.g., passive radiator system tuning frequency, air volume in the acoustic enclosure).

Generally speaking, as the size of the surround gets smaller, a lower durometer material can be used. The use of a soft durometer material gives better design control for low free air resonant frequencies of the diaphragm to keep this resonant frequency away from the tuning frequencies of the moving mass of the diaphragm/surround assembly and an acoustic enclosure in which the surround is used.

The frame 28 is secured to and supports surround 26, and in this example is made of the same material used for diaphragm 22. Alternatively, the frame 28 and the diaphragm 22 can be made of different materials. The frame 28 includes a series of holes 30 that are used with fasteners (not shown) to secure the passive radiator 20 to another structure such as a housing defining an acoustic volume. The arrangement of the frame 28, surround 26, and diaphragm 22 provides a substantially linear force-deflection response of the diaphragm, which can advantageously result in low harmonic distortions and better dynamic performance as the diaphragm moves away from its home position in an intended direction of travel.

The passive radiator 20 is typically made by forming the diaphragm 22 and the frame 28 in separate injection molding operations. The diaphragm 22 and frame 28 are then placed in an insert mold, and a thermoplastic or thermoset elastomer is injected into the mold. The elastomer is allowed to cure, thus forming the surround 26. The thermoset elastomer covers the surfaces of the diaphragm 22 and the frame 28 which face the surround 26. This assists in securing (joining) the surround 26 to the diaphragm 22 and the frame 28. The elastomer preferably also covers at least part of surfaces 32 and 36 (and their opposing surfaces, not shown), thereby helping to secure the surround 26 to the diaphragm 22 and the frame 28.

Figure 2:
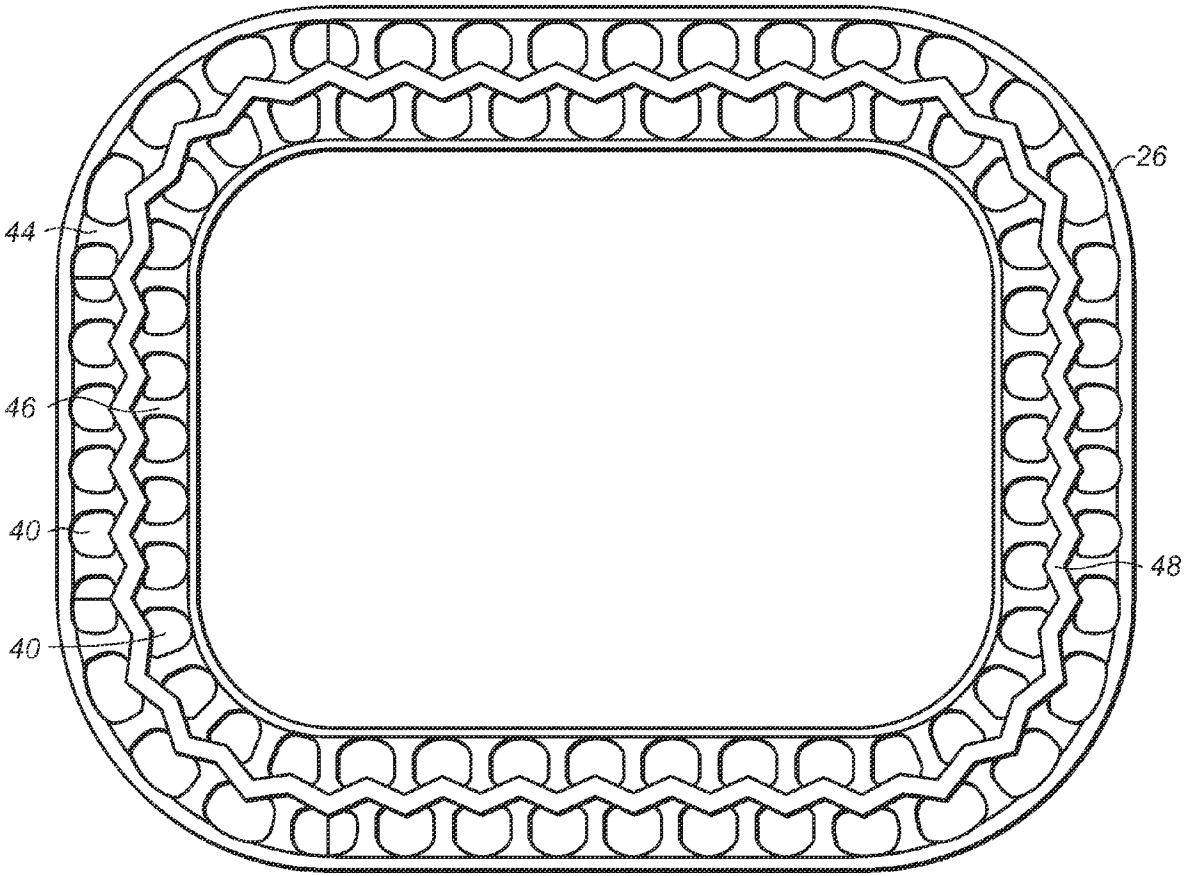
FIG. 2 is a top view of a surround shown in FIG. 1.
Figure 3A:
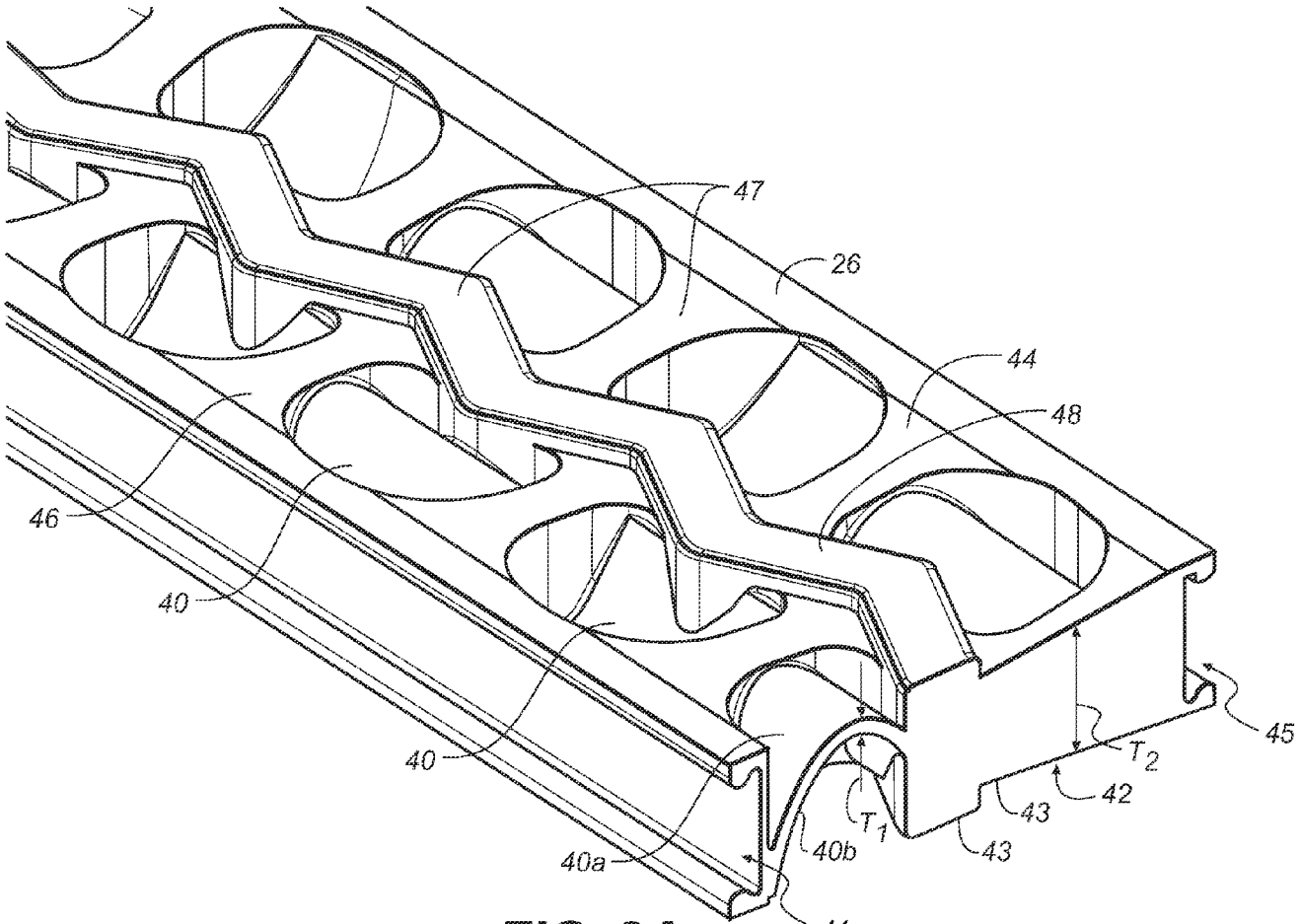
FIGS. 3A and 3B are sectional perspective views of a portion of the surround shown in FIG. 2.

Turning now to FIGS. 2 and 3A, further details of the geometry of the surround 26 will be described. The surround includes a plurality of curved membrane sections 40 which have a thickness $T_1$ of preferably between about 0.1 mm to about 5 mm (FIG. 3A). Thickness $T_1$ is measured in a direction substantially normal to opposing top and bottom surfaces 40*a* and 40*b* of membrane section 40. In this example each membrane section is about 1 mm thick. It is preferable that each membrane section be at least partially curved. Also note in FIG. 3A that the membranes have alternating convex and concave shapes. The diaphragm 22 (FIG. 1) is secured to the surround 26 by an over-mold feature 41 that is created when the surround 26 is insert-molded to the diaphragm 22. Likewise, the frame 28 (FIG. 1) is secured to the surround 26 by an over-mold feature 45 that is created when the surround 26 is insert-molded to the frame 28.

Each membrane section 40 is supported by a support section 42. In this example the support section includes a pair of radial ribs 44, 46 (rib sections) as well as a generally zigzag shaped rib 48 (rib section) which all support the membrane section 40. The rib 48 extends about the perimeter of the diaphragm (the rib 48 extends about at least a portion of the perimeter of the diaphragm in some embodiments). The ribs 44 and 46 extend away from the diaphragm. All three of these ribs (44, 46, 48) have a thickness $T_2$ of between about 6 mm to about 25 mm. The ribs 44, 46 and 48 each have a surface 47 (a top surface) that is substantially flat and substantially perpendicular to an intended direction of travel of the diaphragm 22 (FIG. 1). A bottom surface 43 of ribs 44, 46 and 48 is also substantially flat. Thickness $T_2$ is measured in a direction substantially normal to opposing top and bottom surfaces 47 and 43 of ribs 44, 46 and 48. In this example, the thickness $T_2$ ranges from about 8.5-10 mm resulting in the membrane sections 40*a*, 40*b* being substantially thinner than the ribs. The membrane and ribs are preferably made of substantially the same material.

Figure 3B:
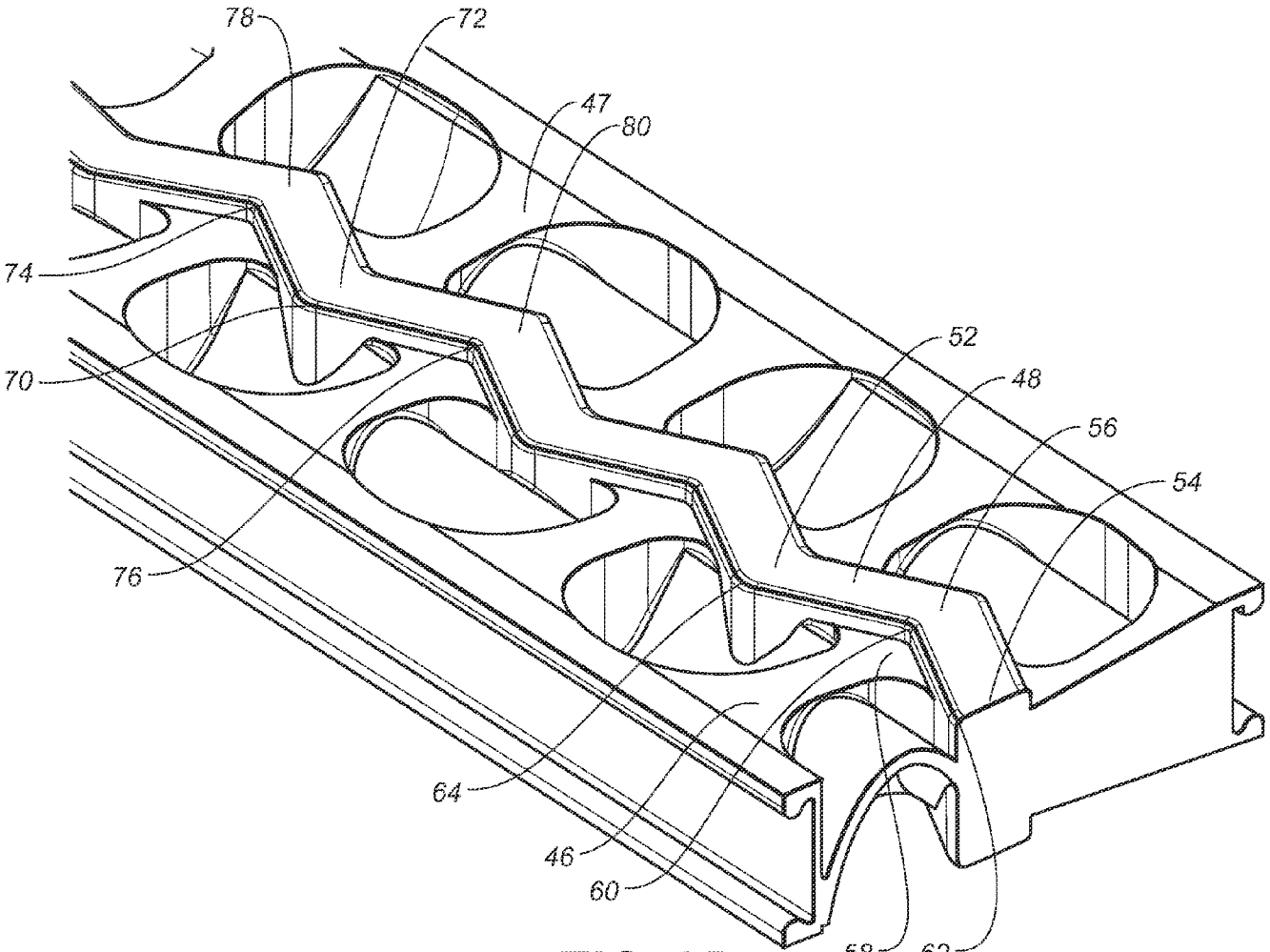

FIG. 3B shows the same surround portion as is shown in FIG. 3A and is provided to keep FIG. 3A from becoming overrun with reference numerals. In FIG. 3B the rib section 48 has two end portions 52 and 54, as well as a middle portion 56. An end 58 of the rib section 46 is secured to the middle portion 56 of the rib section 48. The rib section 46 is closer to the diaphragm (not shown) than the rib section 48. A point 60 on the middle portion 56 of the rib section 48 that is located closest to the diaphragm is located farther from the diaphragm than respective points 62 and 64 that are located on end portions of the rib section that are closest to the diaphragm. In a preferred example, the point 60 is located farther from the diaphragm than at least one of the points 62 and 64 of the rib section 48.

In another portion of the rib section 48, a point 70 on a middle portion 72 of the rib section 48 that is closest to the diaphragm is located closer to the diaphragm than respective points 74 and 76 on end portions 78 and 80 of the rib section 48 that are closest to the diaphragm. In a preferred example, the point 70 is located closer to the diaphragm than at least one of the points 74 and 76 of the rib section 48. It should be noted that a middle portion of one rib section can also be an end portion of an adjacent rib section. For example, end portion 80 can also be a middle portion of a rib section immediately to the right in FIG. 3B.

The length of the rib 48 needs to get longer as the diaphragm 22 is deflected away from its home position. If the rib 48 had a straight shape in the home position instead of a zigzag shape, it would go into tension as soon as the diaphragm 22 was deflected away from its home position. The consequence of such a straight center rib going into tension would be that the surround stiffness would increases at high diaphragm excursions, resulting in an undesired non-linearity in the force versus deflection curve of the surround. In general, a tensioned rib is more nonlinear than a bending rib. By configuring the rib 48 in a generally zigzag shape, it can get longer with much less tension than in the case where the rib 48 was straight in the home position. This reduction in tension with the zigzag rib 48 results in less of an increase in stiffness, thus improving the linearity of the force versus deflection curve of the surround 26.

Another way to describe the surround geometry shown in FIG. 3B is as follows. The rib 46 is secured to a portion 56 of the rib 48 which is farther from the diaphragm than at least one other portion (e.g. portion 52) of the rib 48. Likewise, a rib 47 is secured to a portion 72 of the rib 48 which is farther from the frame 28 (FIG. 1) than at least one other portion (e.g., portion 80) of the rib 48.

Figure 4A:
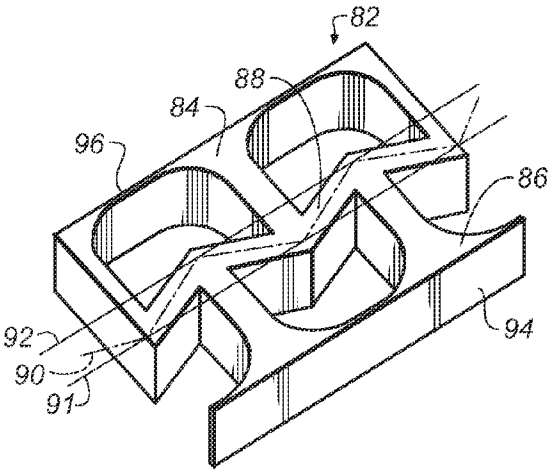
FIGS. 4A-D are sectional perspective views of an example of a surround in various positions.

FIGS. 4A-4D show another example of a portion of a surround 82. Referring first to FIG. 4A, the surround 82, like the surround 26, has radial ribs (rib sections) 84 and 86, as well as a zigzag shaped rib 88 (rib section) which is secured to an end of each of the ribs 84 and 86. Specifically, the rib section 84 extends from the zigzag rib 88 to the frame. The rib section 86 extends from the zigzag 88 to the diaphragm 22 (FIG. 1). Membrane sections are not shown in FIGS. 4A-D. A line 90 represents a centerline of the zigzag rib 88. The lines 91 and 92 connect respective points on the line 90 which are either closer to the diaphragm or closer to the frame. Half of the distance between the lines 91 and 92 is the zigzag offset which is preferably about 2-3 mm (in FIG. 4A the offset is about 4 mm to assist in explaining the geometry). A diaphragm (not shown) is secured to a surface 94 of the surround 82 and a frame is secured to a surface 96 of the surround 82.

Figure 4B:
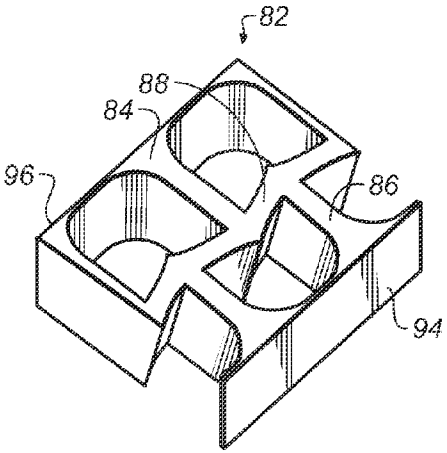

With reference to FIG. 4B, as the diaphragm starts moving away from a home position (at rest with equal air pressure on both sides of the diaphragm) in an intended direction of travel which is substantially perpendicular to a plane in which the diaphragm lies when the diaphragm is in the home position, the zigzag pattern of the rib section 88 starts to straighten out. Another way of describing this occurrence is that as the diaphragm starts moving away from the home position in the intended direction of travel, a geometric shape of the rib section 88 starts changing from a shape which is less similar to a corresponding portion of the perimeter of the diaphragm (FIG. 1) to a shape which is more like the corresponding portion of the perimeter of the diaphragm. In FIG. 4B the diaphragm has moved about 8 mm away from the home position. This happens because the diaphragm pulls on surface 94 which in turn pulls on ribs 86 which pulls on the rib 88. As the surface 96 is secured to the frame (not shown), the rib 84 pulls on the rib 88 in a direction opposite to that in which ribs 86 pull on the rib 88.

Figure 4C:
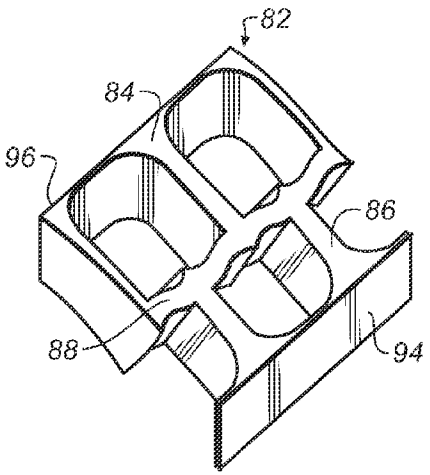
Figure 4D:
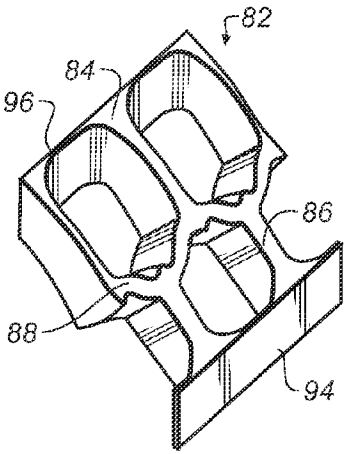

In FIG. 4C the diaphragm has moved farther away from the home position (a total of 16 mm) in the intended direction of travel than in FIG. 4B. As such, the rib 88 has substantially straightened out. The phrase "Straighten out" is also intended to cover an arrangement where the rib 88 is extending about a curved section of the perimeter of the diaphragm. In this case, when the rib 88 "straightens out", it will still have a generally curved shape as it corresponds to the perimeter of the diaphragm. Finally, in FIG. 4D the diaphragm has moved even farther away from the home position (a total of 25 mm) in the intended direction of travel than in FIG. 4C. As such, the rib 88 has again started to take on a zigzag shape which is the reverse of the zigzag shape of the rib 88 in FIG. 4A. Further movement the diaphragm away from the home position, is decreasingly allowed by a geometric change in the surround 82 and increasingly by a stretching (elastic deformation) of the surround 82.

Figure 5:
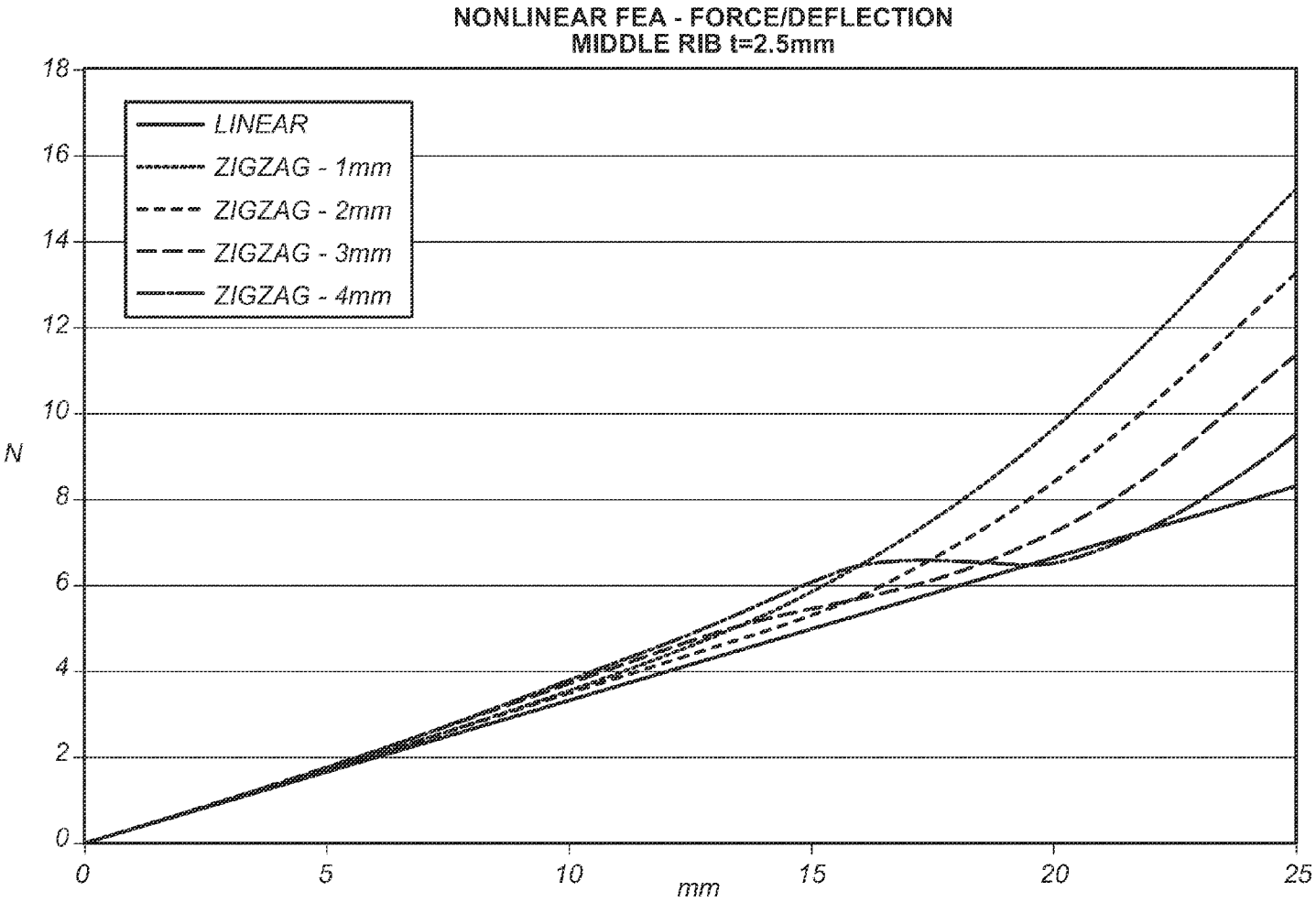
FIG. 5 is a force/deflection plot of various rib zigzag offsets.

FIG. 5 is a finite element analysis which plots the force in newtons applied to the diaphragm on the Y axis verses the diaphragm deflection away from its home position in the intended direction of travel on the X axis for various zigzag offsets. The solid line in the plot represents a linear force-deflection response which is preferably desired. The other lines in the plot represent force-deflection responses for various zigzag offsets. The preferred zigzag offset is about 2-3 mm. With a 4 mm offset buckling (an undesirable response) has occurred. A 1 mm offset provides a less linear response that an offset that is about 2-3 mm. It should be noted that these zigzag offset response curves can vary depending on a number of variables, including the thickness of rib 88 in a direction parallel to the intended direction of travel of the diaphragm, and the span of rib 88 (in a direction substantially parallel to a long axis of the rib 86 in FIG. 4C). A restoring force which returns the diaphragm to the home position is contributed to more due to deformation of the radial rib sections 44 and 46 (FIGS. 3A, 3B) than to deformation of the membrane section 40 (FIG. 2, 3A, 3B).

With renewed reference to FIGS. 2, 3A, and 3B, although the ribs 44, 46 are shown extending away at about a 90° angle to the diaphragm 22, ribs 44, 46 can be arranged to extend at an angle less than 90° (e.g., at an angle of 60°). It should be noted that the interface between membrane section 40 and another element (e.g. rib 46) can be filleted. Because membrane section 40 and support section 42 are unitary, air leakage through the interface between the membrane section and support section are minimized or eliminated in preferred embodiments.

In general, the ribs of the support section provide a linear force-deflection response and the thin membrane provides a non-linear force deflection response. The total stiffness is a summation of the ribbed and the membrane responses, so it is desirable to minimize the contribution of the membrane. One example provides a substantially linear performance of the system over a 22 mm peak-to-peak travel of the diaphragm. In one example using a soft silicone rubber, the rubber of the surround goes through an elongation or strain of about 30%.

The zigzag rib described above improves geometry linearity, and therefore improves the overall force-deflection relationship of the passive radiator with a given set of material properties. With improved linearity of the force deflection relationship, the passive radiator will also have better dynamic stability. An additional advantage of the zigzag rib described above is that it increases the in-plane (of the diaphragm at rest) to axial (the intended direction of travel of the diaphragm) stiffness ratio, which helps to raise the in-plane stiffness without increasing the axial stiffness.

While the invention has been particularly shown and described with reference to specific examples shown and described above, it is evident that those skilled in the art may now make numerous modifications of, departures from and uses of the specific apparatus and techniques herein disclosed. For instance, while the examples described herein are generally rectangular in shape, surrounds can be created in a number of other forms such as square, circular or race-track shaped. Additionally, there are many different ways of arranging the ribs and membranes of the surround in addition to the several that have been described herein. For example, although a zigzag pattern has been shown for the rib 48, other types of patterns may be used for this rib which allows the rib to straighten out when the diaphragm is moved in an intended direction of travel. Consequently, the invention is to be construed as embracing each and every novel feature and novel combination of features presented in or possessed by the apparatus and techniques herein disclosed and limited only by the spirit and scope of the appended claims.

What is claimed is:

1. A surround for supporting a diaphragm used to create acoustic waves, comprising:

a first rib section extending away from the diaphragm;

a second rib section having two end portions and a middle portion, an end of the first rib section being secured to the middle portion of the second rib section, the first rib section being closer to the diaphragm than the second rib section; and a first membrane section that is supported by the first rib section, the membrane section having a thickness in a direction substantially normal to opposing top and bottom surfaces of the membrane section which is substantially thinner than a thickness of the first rib section in a direction substantially normal to opposing top and bottom surfaces of the first rib section, a point on the middle portion of the second rib section that is closest to the diaphragm being located farther from the diaphragm than a point on at least one of the end portions of the second rib section that is closest to the diaphragm.

2. The surround of claim 1, wherein the point on the middle portion of the second rib section is located farther from the diaphragm than respective points on both of the end portions of the second rib section that are closest to the diaphragm.

3. The surround of claim 1, wherein the thickness of the membrane section is substantially thinner than a thickness of the second rib section in a direction substantially normal to opposing top and bottom surfaces of the second rib section.

4. The surround of claim 1, wherein at least a portion of the membrane has a curved shape.

5. The surround of claim 1, further comprising:

a third rib section extending away from the diaphragm;

a fourth rib section having two end portions and a middle portion, an end of the third rib section being secured to the middle portion of the fourth rib section; and a second membrane section that is supported by the third rib section, the membrane section having a thickness in a direction substantially normal to opposing top and bottom surfaces of the membrane section which is substantially thinner than a thickness of the third rib section in a direction substantially normal to opposing top and bottom surfaces of the third rib section, a point on the middle portion of the fourth rib section that is closest to the diaphragm being located closer to the diaphragm than a point on at least one of the end portions of the fourth rib section that is closest to the diaphragm.

6. The surround of claim 5, wherein the point on the middle portion of the fourth rib section is located closer to the diaphragm than respective points on both of the end portions of the fourth rib section that are closest to the diaphragm.

7. The surround of claim 5, wherein the thickness of the membrane section is substantially thinner than a thickness of the fourth rib section in a direction substantially normal to opposing top and bottom surfaces of the fourth rib section.

8. A surround for supporting a diaphragm used to create acoustic waves, comprising:

a first rib section extending away from a frame which supports the surround;

a second rib section having two end portions and a middle portion, an end of the first rib section being secured to the middle portion of the second rib section, the first rib section being closer to the frame than the second rib section; and a first membrane section that is supported by the first rib section, the membrane section having a thickness in a direction substantially normal to opposing top and bottom surfaces of the membrane section which is substantially thinner than a thickness of the first rib section in a direction substantially normal to opposing top and bottom surfaces of the first rib section, a point on the middle portion of the second rib section that is closest to the diaphragm being located closer to the diaphragm than a point on at least one of the end portions of the second rib section that is closest to the diaphragm.

9. The surround of claim 8, wherein the point on the middle portion of the second rib section is located closer to the diaphragm than respective points on both of the end portions of the second rib section that are closest to the diaphragm.

10. The surround of claim 8, wherein the thickness of the membrane section is substantially thinner than a thickness of the second rib section in a direction substantially normal to opposing top and bottom surfaces of the second rib section.

11. The surround of claim 8, wherein at least a portion of the membrane has a curved shape.

12. The surround of claim 8, further comprising:

a third rib section extending away from the diaphragm;

a fourth rib section having two end portions and a middle portion, an end of the third rib section being secured to the middle portion of the fourth rib section; and a second membrane section that is supported by the third rib section, the membrane section having a thickness in a direction substantially normal to opposing top and bottom surfaces of the membrane section which is substantially thinner than a thickness of the third rib section in a direction substantially normal to opposing top and bottom surfaces of the third rib section, a point on the middle portion of the fourth rib section that is closest to the diaphragm being located farther from the diaphragm than a point on at least one of the end portions of the fourth rib section that is closest to the diaphragm.

13. The surround of claim 12, wherein the point on the middle portion of the fourth rib section is located farther from the diaphragm than respective points on both of the end portions of the fourth rib section that are closest to the diaphragm.

14. The surround of claim 12, wherein the thickness of the membrane section is substantially thinner than a thickness of the fourth rib section in a direction substantially normal to opposing top and bottom surfaces of the fourth rib section.

15. A surround for supporting a diaphragm used to create acoustic waves, comprising:

a first rib section extending away from the diaphragm;

a second rib section having a zigzag pattern and being secured to an end of the first rib section, wherein as the diaphragm starts moving away from a home position in an intended direction of travel which is substantially perpendicular to a plane in which the diaphragm lies when the diaphragm is in the home position, the zigzag pattern of the second rib section starts to straighten out.

16. The surround of claim 15, wherein a point on a middle portion of the second rib section is located farther from the diaphragm than respective points on both end portions of the second rib section that are closest to the diaphragm.

17. The surround of claim 15, wherein a thickness of a membrane section is substantially thinner than a thickness of the second rib section in a direction substantially normal to opposing top and bottom surfaces of the second rib section.

18. The surround of claim 15, wherein at least a portion of the membrane has a curved shape.

19. The surround of claim 15, wherein a point on a middle portion of the second rib section is located closer to the diaphragm than respective points on both end portions of the second rib section that are closest to the diaphragm.

20. A surround for supporting a diaphragm used to create acoustic waves, comprising:

a first rib section extending away from the diaphragm;

a second rib section secured to an end of first rib section and extending about at least a portion of a perimeter of the diaphragm, wherein as the diaphragm starts moving away from a home position in an intended direction of travel which is substantially perpendicular to a plane in which the diaphragm lies when the diaphragm is in the home position, a geometric shape of the second rib section starts changing from a shape which is less similar to the at least portion of the perimeter of the diaphragm to a shape which is more like the at least portion of the perimeter of the diaphragm.

* * * * *

UNITED STATES PATENT AND TRADEMARK OFFICE

CERTIFICATE OF CORRECTION

PATENT NO. : 8,397,861 B1
APPLICATION NO. : 13/410636
DATED : March 19, 2013
INVENTOR(S) : Zhen Xu et al.

It is certified that error appears in the above-identified patent and that said Letters Patent is hereby corrected as shown below:

Title page,

Item (75), delete the city "Waltham" for inventor Zhen Xu, and replace it with the city "Westford".

Signed and Sealed this
Tenth Day of December, 2013

Margaret A. Focarino

Margaret A. Focarino
*Commissioner for Patents of the United States Patent and Trademark Office*